United States Patent [19]

Dairiki et al.

[11] Patent Number: 4,494,205

[45] Date of Patent: Jan. 15, 1985

[54] METHOD OF ROLLING METAL

[75] Inventors: Osamu Dairiki; Humio Ookuma; Hiroyuki Asano, all of Oita, Japan

[73] Assignee: Nippon Steel Corporation, Tokyo, Japan

[21] Appl. No.: 333,782

[22] Filed: Dec. 23, 1981

[30] Foreign Application Priority Data

Dec. 26, 1980 [JP] Japan ..... 55-185616

[51] Int. Cl.[3] ..... G05B 13/04; B21B 37/00

[52] U.S. Cl. ..... 364/472; 72/11; 72/16

[58] Field of Search ..... 364/472; 72/11, 16, 72/20

[56] References Cited

U.S. PATENT DOCUMENTS

| | | | |
|---|---|---|---|
| 3,332,263 | 7/1967 | Beadle et al. | 72/7 |
| 3,631,697 | 1/1972 | Deramo | 72/8 |
| 3,694,636 | 9/1972 | Smith, Jr. | 364/472 |
| 4,137,742 | 2/1979 | Tanifuji et al. | 364/472 |
| 4,220,025 | 9/1980 | Baba et al. | 72/16 |
| 4,244,025 | 1/1981 | Alshuk | 364/472 |
| 4,248,072 | 2/1981 | Hasegawa et al. | 364/472 |
| 4,269,051 | 5/1981 | Clark | 364/472 |
| 4,292,825 | 10/1981 | Morooka et al. | 72/16 |

*Primary Examiner*—Jerry Smith
*Assistant Examiner*—John R. Lastova
*Attorney, Agent, or Firm*—Cushman, Darby & Cushman

[57] ABSTRACT

In a method of rolling metal for producing a metal plate or a metal sheet having a desired range of thickness through a sequence of rolling passes, variations in the deformation resistance of the metal along the longitudinal direction of the metal are detected, variations in deformation resistance and the resulting variations in rolling force in the finishing pass are estimated, and the rolling for obtaining the necessary thickness of the metal at the entrance of the finishing pass is carried out under a combination of a feedback automatic gauge control process and feed-forward automatic gauge control process, whereby variations in the rolling force are cancelled even if the metal which is to be rolled has skid marks thereon.

4 Claims, 20 Drawing Figures

| Fig. 1A | Fig. 1B |
|---|---|

| Fig. 3A | Fig. 3B |
|---|---|

CALCULATED PLATE THICKNESS

ROLL GAP LENGTH

ROLLING FORCE

CALCULATED PLATE THICKNESS

ROLL GAP LENGTH

ROLLING FORCE

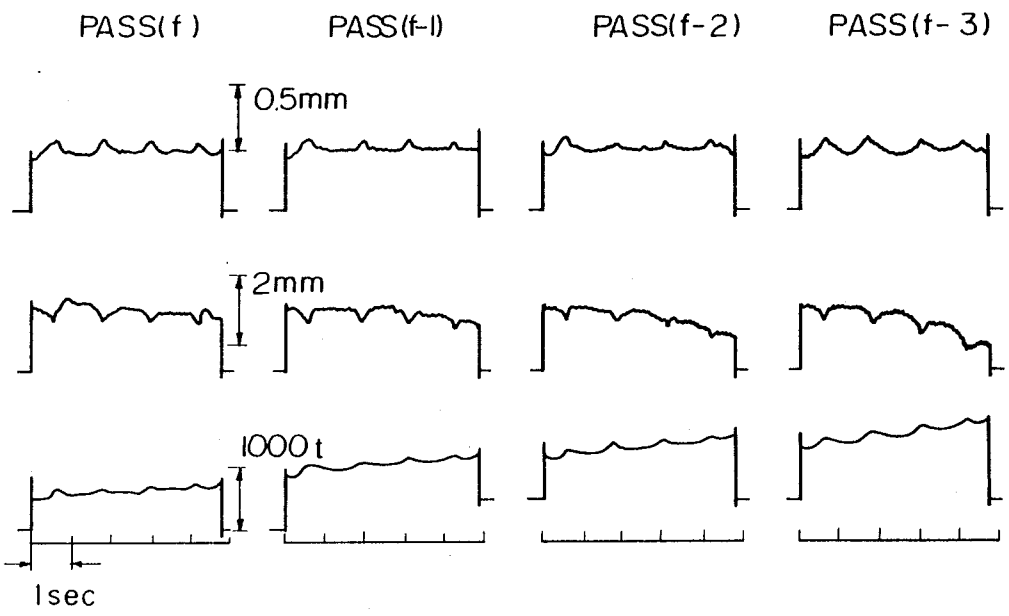
Fig. 6a CALCULATED PLATE THICKNESS
Fig. 6b ROLL GAP LENGTH
Fig. 6c ROLLING FORCE

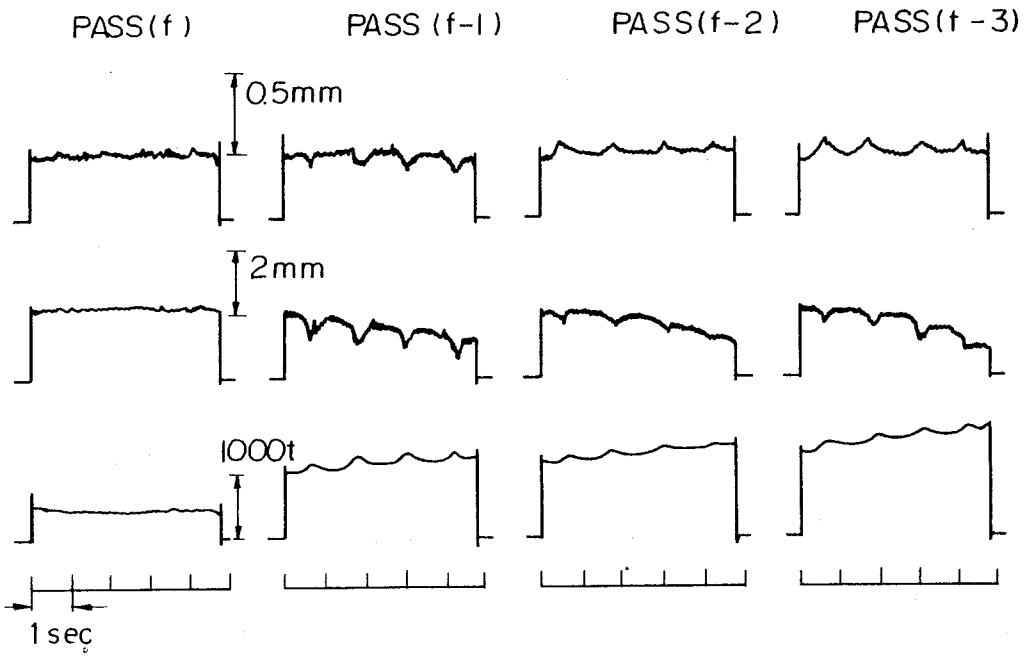
Fig. 7a CALCULATED PLATE THICKNESS
Fig. 7b ROLL GAP LENGTH
Fig. 7c ROLLING FORCE

Fig. 8

| WIDTH / THICKNESS | <2000mm | | <2500mm | | <3000mm | | <3500mm | | <4000mm | | ≧4000mm | |
|---|---|---|---|---|---|---|---|---|---|---|---|---|
| < 10.0mm | 20<br>0.18<br>0.05 | 140<br>0.14<br>0.04 | 20<br>0.16<br>0.04 | 179<br>0.11<br>0.44 | 20<br>0.15<br>0.03 | 165<br>0.11<br>0.03 | 20<br>0.15<br>0.01 | 86<br>0.10<br>0.04 | 12<br>0.13<br>0.05 | 8<br>0.13<br>0.03 | 10<br>0.16<br>0.10 | 1<br>0.12 |
| < 15.0mm | 20<br>0.16<br>0.04 | 108<br>0.12<br>0.03 | 20<br>0.13<br>0.04 | 62<br>0.10<br>0.03 | 20<br>0.18<br>0.07 | 113<br>0.11<br>0.44 | 20<br>0.13<br>0.04 | 65<br>0.12<br>0.06 | 20<br>0.13<br>0.04 | 15<br>0.12<br>0.04 | 15<br>0.14<br>0.08 | 2<br>0.14<br>0.04 |
| < 20.0mm | 20<br>0.16<br>0.05 | 73<br>0.15<br>0.04 | 20<br>0.19<br>0.04 | 88<br>0.11<br>0.05 | 20<br>0.16<br>0.05 | 93<br>0.11<br>0.55 | 20<br>0.15<br>0.07 | 18<br>0.11<br>0.06 | 6<br>0.24<br>0.22 | 48<br>0.12<br>0.05 | 4<br>0.15<br>0.05 | 8<br>0.15<br>0.04 |
| < 30.0mm | 20<br>0.21<br>0.07 | 58<br>0.17<br>0.06 | 20<br>0.21<br>0.05 | 49<br>0.15<br>0.05 | 20<br>0.17<br>0.08 | 26<br>0.17<br>0.05 | 20<br>0.15<br>0.05 | 40<br>0.14<br>0.05 | 5<br>0.13<br>0.04 | 2<br>0.09<br>0.10 | –<br>–<br>– | –<br>–<br>– |
| ≧ 30.0mm | 20<br>0.29<br>0.07 | 23<br>0.25<br>0.12 | 22<br>0.29<br>0.10 | 7<br>0.23<br>0.10 | 13<br>0.26<br>0.12 | 6<br>0.19<br>0.02 | 7<br>0.25<br>0.07 | 4<br>0.17<br>0.03 | 7<br>0.24<br>0.07 | –<br>–<br>– | 2<br>0.18<br>0.03 | –<br>–<br>– |

Fig. 9

| Fig. 9A |
|---|
| Fig. 9B |

Fig. 9 A

| THICKNESS \ WIDTH | < 700mm | | < 900mm | | < 1100mm | | < 1300mm | | < 1600mm | | < 2000mm | | ≧2000mm | |
|---|---|---|---|---|---|---|---|---|---|---|---|---|---|---|
| < 1.8 mm | 61 | 47 | 153 | 140 | 328 | 428 | 717 | 811 | 188 | 158 | 13 | 14 | | |
| | 0.047 | 0.024 | 0.048 | 0.025 | 0.046 | 0.023 | 0.047 | 0.024 | 0.046 | 0.023 | 0.046 | 0.023 | | |
| | 0.035 | 0.019 | 0.033 | 0.020 | 0.032 | 0.019 | 0.033 | 0.019 | 0.034 | 0.019 | 0.035 | 0.019 | | |
| < 2.0 mm | 11 | 20 | 91 | 179 | 255 | 529 | 88 | 126 | 35 | 25 | 23 | 26 | | |
| | 0.033 | 0.009 | 0.031 | 0.009 | 0.030 | 0.008 | 0.033 | 0.009 | 0.031 | 0.010 | 0.035 | 0.010 | | |
| | 0.032 | 0.020 | 0.029 | 0.020 | 0.030 | 0.019 | 0.031 | 0.019 | 0.029 | 0.020 | 0.030 | 0.022 | | |
| < 2.3 mm | 48 | 103 | 1134 | 1196 | 1240 | 1484 | 355 | 910 | 88 | 123 | 27 | 22 | | |
| | 0.030 | 0.005 | 0.027 | 0.005 | 0.028 | 0.005 | 0.029 | 0.006 | 0.029 | 0.005 | 0.031 | 0.007 | | |
| | 0.028 | 0.019 | 0.025 | 0.017 | 0.027 | 0.015 | 0.027 | 0.015 | 0.027 | 0.016 | 0.029 | 0.018 | | |
| < 3.0 mm | 16 | 43 | 336 | 284 | 676 | 998 | 556 | 1058 | 209 | 99 | 54 | 16 | | |
| | 0.028 | 0.006 | 0.026 | 0.006 | 0.025 | 0.005 | 0.026 | 0.005 | 0.026 | 0.005 | 0.028 | 0.008 | | |
| | 0.033 | 0.018 | 0.032 | 0.015 | 0.032 | 0.014 | 0.032 | 0.014 | 0.032 | 0.014 | 0.031 | 0.016 | | |
| < 4.0 mm | 13 | 28 | 323 | 445 | 905 | 1150 | 625 | 786 | 166 | 222 | 61 | 18 | 19 | 19 |
| | 0.036 | 0.005 | 0.034 | 0.006 | 0.034 | 0.005 | 0.034 | 0.005 | 0.035 | 0.007 | 0.035 | 0.009 | 0.037 | 0.010 |
| | 0.033 | 0.018 | 0.033 | 0.016 | 0.033 | 0.014 | 0.032 | 0.014 | 0.032 | 0.015 | 0.034 | 0.017 | 0.035 | 0.015 |

Fig. 9B

| THICKNESS \ WIDTH | < 700mm | | < 900mm | | < 1100mm | | < 1300mm | | < 1600mm | | < 2000mm | | ≧2000mm | |
|---|---|---|---|---|---|---|---|---|---|---|---|---|---|---|
| < 5.0 mm | 15 | 24 | 96 | 159 | 293 | 362 | 351 | 317 | 217 | 249 | 64 | 43 | 46 | 51 |
| | 0.033 | 0.008 | 0.032 | 0.008 | 0.031 | 0.007 | 0.031 | 0.007 | 0.031 | 0.008 | 0.032 | 0.007 | 0.033 | 0.010 |
| | 0.039 | 0.022 | 0.037 | 0.021 | 0.037 | 0.019 | 0.039 | 0.019 | 0.039 | 0.020 | 0.035 | 0.023 | 0.040 | 0.023 |
| < 6.0 mm | 59 | 49 | 25 | 16 | 223 | 430 | 72 | 126 | 172 | 335 | 247 | 26 | 38 | 33 |
| | 0.032 | 0.008 | 0.030 | 0.008 | 0.030 | 0.007 | 0.029 | 0.006 | 0.030 | 0.008 | 0.031 | 0.009 | 0.032 | 0.008 |
| | 0.047 | 0.018 | 0.044 | 0.018 | 0.044 | 0.019 | 0.043 | 0.020 | 0.045 | 0.020 | 0.043 | 0.020 | 0.045 | 0.021 |
| < 8.0 mm | 57 | 128 | 88 | 136 | 202 | 391 | 1015 | 657 | 266 | 434 | 49 | 103 | 30 | 27 |
| | 0.037 | 0.011 | 0.037 | 0.010 | 0.037 | 0.010 | 0.037 | 0.010 | 0.038 | 0.011 | 0.037 | 0.011 | 0.039 | 0.012 |
| | 0.057 | 0.024 | 0.057 | 0.022 | 0.057 | 0.022 | 0.055 | 0.022 | 0.057 | 0.023 | 0.059 | 0.023 | 0.057 | 0.024 |
| < 10.0 mm | 14 | 20 | 413 | 119 | 268 | 397 | 315 | 403 | 296 | 624 | 142 | 354 | 10 | 12 |
| | 0.048 | 0.016 | 0.045 | 0.015 | 0.046 | 0.015 | 0.046 | 0.015 | 0.047 | 0.016 | 0.047 | 0.015 | 0.048 | 0.018 |
| | 0.047 | 0.022 | 0.045 | 0.021 | 0.047 | 0.021 | 0.045 | 0.021 | 0.045 | 0.021 | 0.050 | 0.022 | 0.049 | 0.023 |
| ≧10.0 mm | 18 | 18 | 22 | 27 | 215 | 193 | 421 | 368 | 1088 | 1048 | 282 | 393 | 16 | 14 |
| | 0.049 | 0.018 | 0.049 | 0.015 | 0.048 | 0.015 | 0.047 | 0.015 | 0.048 | 0.015 | 0.048 | 0.016 | 0.048 | 0.016 |
| | 0.046 | 0.023 | 0.046 | 0.023 | 0.045 | 0.023 | 0.045 | 0.023 | 0.046 | 0.024 | 0.046 | 0.023 | 0.045 | 0.025 |

METHOD OF ROLLING METAL

TECHNICAL FIELD

The present invention relates to a method of rolling metal, such as steel, for producing a metal plate or a metal sheet having a predetermined range of thickness through a sequence of rolling passes under, for example, hot conditions.

BACKGROUND ART

In general, a slab which has been conveyed through a continuous reheating furnace by means of a walking beam system bears skid marks caused by the low-temperature top portions of the fixed beams and walking beams, through which coolant flows. It is known that the skid marks cause differences in plastic deformation resistance of various portions of the slab and, hence, cause differences in thickness in various portions of the plate or a sheet produced by rolling the slab.

When a slab bearing skid marks is rolled by a rolling mill, there is first a problem in obtaining a uniform thickness of the rolled plate or sheet. The larger the thickness of the slab, the shorter the relative space between the adjacent lowest temperature points, which correspond to adjacent skid marks.

Accordingly, a feedback automatic gauge control system of a rolling mill applied to such a slab would necessitate high frequency response characteristics in the automatic gauge control system for the rolling mill to which the slab is applied. However, in practice, there is a limit to enhancing frequency response characteristics in feedback automatic gauge control. In any event, it is difficult to eliminate deviations in thickness caused by the skid marks in a conventional feedback automatic gauge control process with a control system having usual frequency response characteristics.

A feed-forward automatic gauge control system of a rolling mill applied to such slab would operate satisfactorily only with precise estimation of rolling force. However, since it was difficult to carry out precise estimation of rolling force, it has been recognized to be difficult to achieve rolling of such slab to a predetermined uniform thickness by prior art feed-forward automatic gauge control systems. Such feed-forward automatic gauge control systems have not been successful. An example of such a feed-forward automatic gauge control system is disclosed in Japanese Patent Publication No. 52-34024.

Second, there is problem in obtaining a high grade of flatness of a rolled plate or sheet. Conventional feedback automatic gauge control systems and conventional feed-forward automatic gauge control systems, operate to standardize the plate thickness at the outlet point of each rolling pass. This accordingly creates variations of roll gap length and variations of rolling force at each pass in accordance with the temperature deviation due to the skid marks. Such variations of rolling force have a detrimental effect on the flatness of the rolled plate or sheet. Thus, it is difficult to successfully apply feedback and feed-forward automatic gauge control systems to steel subject to deterioration of flatness, such as thin steel sheet. Omission of use of feedback and feed-forward automatic gauge control systems in the rolling of thin steel sheets would not allow high-precision control of sheet thickness though it would avoid the above-mentioned deterioration of flatness.

DISCLOSURE OF THE INVENTION

The present invention is proposed in order to solve the above-described problems in the prior art method of rolling.

It is the main object of the present invention to provide an improved method of rolling metal in which the grade of flatness of the rolled metal is maintained above a predetermined level and the precision of standardization of thickness of the rolled metal is enhanced, even when the metal to be rolled has skid marks thereon.

In accordance with an aspect of the present invention, there is provided a method of rolling metal for producing metal plate or sheet having a desired range of thickness through a sequence of rolling passes, said method comprising the steps of: detecting variations in the deformation resistance of the metal, which is being rolled, along the longitudinal direction of the metal; estimating, on the basis of such detected data of the variations in the deformation resistance of the metal, the variations in deformation resistance and the resulting variations in rolling force in the finishing pass along the longitudinal direction of the metal; and rolling for obtaining the necessary thickness of the metal at the entrance of the finishing pass so that the variation in the rolling force is cancelled.

In accordance with another aspect of the present invention, there is provided a method of rolling metal for producing metal plate or sheet having a desired range of thickness through a sequence of rolling passes, said method comprising the steps of: calculating from the rolling force and the roll gap length the metal thickness $H(n-2)$ and $H(n-1)$ along the longitudinal direction of the metal, i.e., the metal thicknesses at the $(n-2)$th pass and the $(B-1)$th pass, respectively, where the nth pass is a certain pass preceding the finishing pass; calculating, in accordance with a rolling force estimation equation, the deformation resistance $K(n-1)$ along the longitudinal direction of the metal at the $(n-1)$th pass from the $H(n-2)$, the $H(n-1)$ and the rolling force $F(n-1)$ along the longitudinal direction of the metal at the $(n-1)$th pass; calculating, in accordance with a deformation resistance estimation equation, the deformation resistance $K(n)$ along the longitudinal direction of the metal at the nth pass; calculating, in accordance with a deformation resistance estimation equation, the deformation resistance $K(n+1)$ along the longitudinal direction of the metal at the $(n+1)$th pass; calculating the metal thickness $H(n)$ which should be attained at the nth pass, in accordance with a rolling force estimation equation, from the command rolling force $F(n+1)$ at the $(n+1)$th pass, the command metal thickness $H(n+1)$ at the $(n+1)$th pass, and $K(n+1)$, said command rolling force $F(n+1)$ and command metal thickness $H(n+1)$ being assumed constant during the $(n+1)$th pass; calculating, in accordance with a rolling force estimation equation, the rolling force $F(n)$ along the longitudinal direction of the metal at the nth pass form the $H(n)$, the $H(n-1)$, and the $K(n)$; calculating the roll gap length $S(n)$ or the variation $\Delta S(n)'$ of the roll gap length corresponding to each of the points along the longitudinal direction of the metal; and rolling at the nth pass, using the command roll gap length or the variation of the command roll gap length $\Delta S(n)$ obtained by multiplying $\Delta S(n)'$ by a constant G, in synchronization with the displacement of the metal.

BRIEF DESCRIPTION OF THE DRAWINGS

FIGS. 4A–C, 5A–C, 6A–C, and 7A–C illustrate the changes with time of the calculated plate thickness, the roll gap length, and the rolling force in accordance with the prior art and the present invention;

FIGS. 8 and 9A and 9B illustrate data obtained from actual operations of the rolling system in accordance with the prior art and the present invention.

DESCRIPTION OF THE PREFERRED EMBODIMENT

Figures 1, 1A:
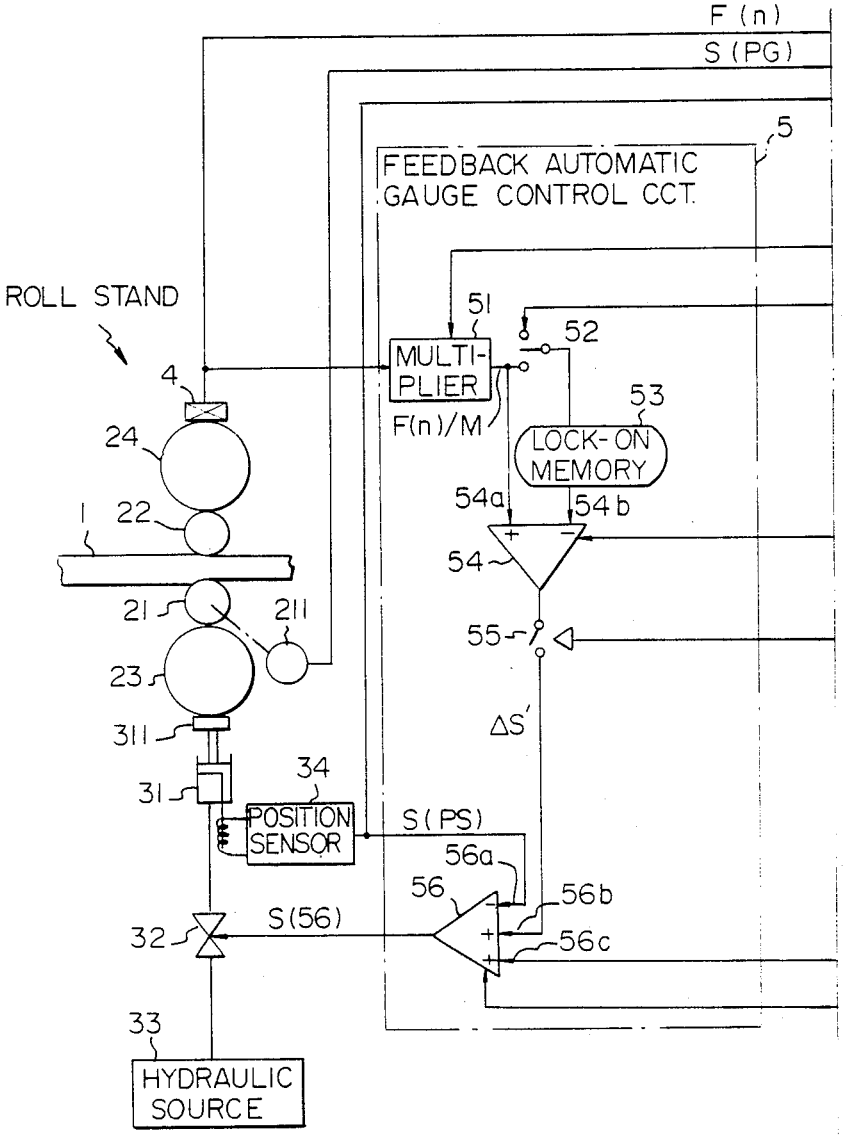
FIGS. 1A and 1B illustrate a system used for carrying out a method of rolling metal in accordance with an embodiment of the present invention.
Figure 1B:
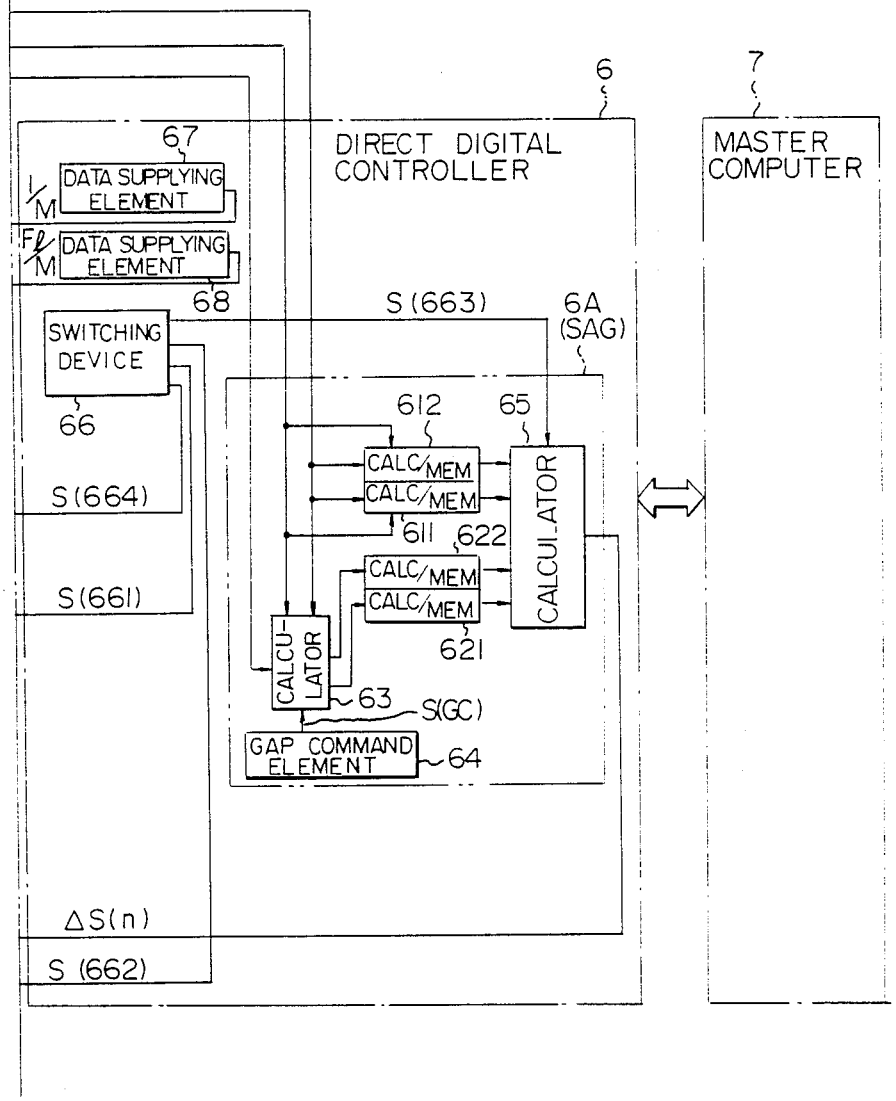
Figure 2:
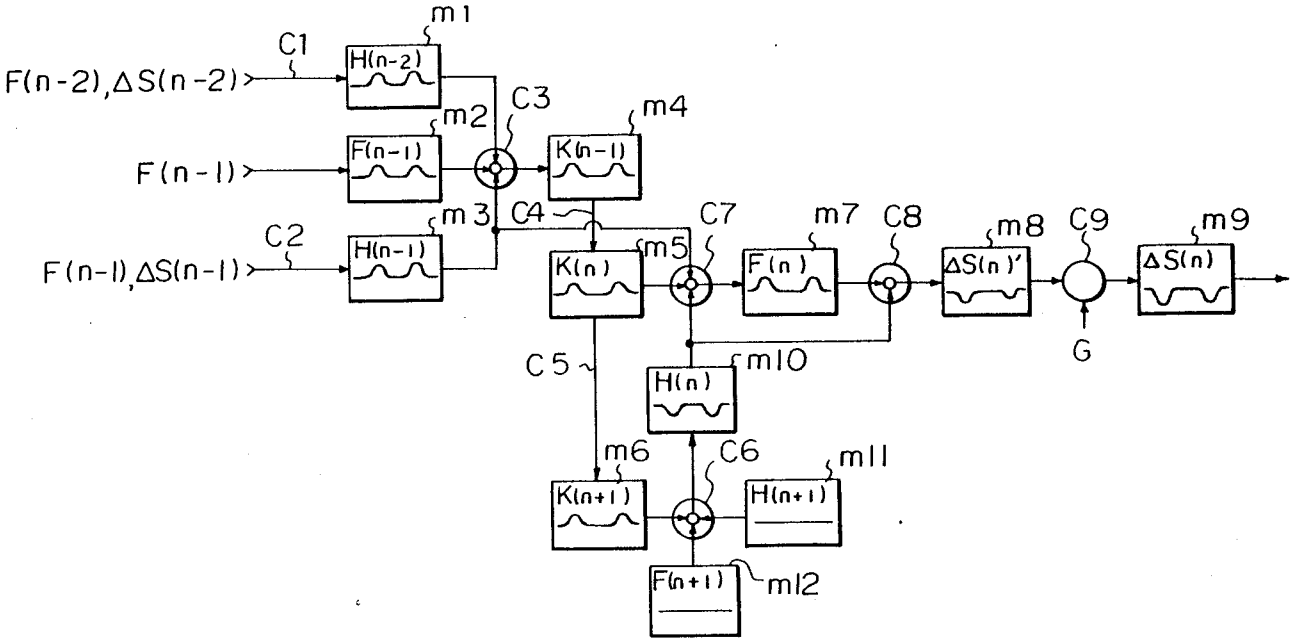
FIG. 2 illustrates a process of calculations carried out in the computing circuits in the system of FIG. 1.

An example of the system used for carrying out the method of rolling metal in a sequence of passes in accordance with the present invention is illustrated in FIG. 1. The system of FIG. 1 is applied to a reversing mill with a single roll stand. An example of the process of calculations carried out in the computing circuits in the system of FIG. 1 is illustrated in FIG. 2.

In the system of FIG. 1, a material such as a steel slab 1 is rolled between a lower work roll 21 and an upper work roll 23 in a roll stand. Below the lower work roll 21 a lower backup roll 23 is provided, while over the upper work roll 22 an upper backup roll 24 is provided.

The position of the lower backup roll 23 is controlled by a hydraulic cylinder device 31 actuated by hydraulic force supplied from the hydraulic source 33 through a control valve 32. The position of an actuating element 311 of the hydraulic cylinder device 31 is sensed by a position sensor 34.

The rotational speed of the lower work roll 21 is sensed by a pulse generator 211 coupled to the lower work roll 21.

The rolling force F(n) is detected by a load cell 4 provided on the upper backup roll 24.

The roll stand is controlled by a control system comprising a feedback automatic gauge control circuit 5, a direct digital controller 6, and a master computer 7.

The feedback automatic gauge control circuit 5 comprises a multiplier 51, a changeover switch 52, a lock-on memory 53, a first operational amplifier 54, a switch 55, and a second operational amplifier 56.

An input signal F(n) of the multiplier 51 is supplied from the load cell 4. Another input signal 1/M of the multiplier is supplied from the element 67 of the direct digital controller 6.

The output signal of the second operational amplifier 56 is supplied to the control valve 32 to control it.

In the circuit diagram in FIG. 1, the illustrations of analog-to-digital or digital-to-analog converters are omitted.

The direct digital controller 6 includes a superautomatic gauge control circuit 6A(SAG) and a switching device 66. The superautomatic gauge control circuit 6A(SAG) comprises calculator/memory elements 611, 612, 621, and 622, a calculator 63, a gap length command element 64, and a calculator 65.

The calculator/memory 612 receives the signal S(PG) for transfer synchronization from the pulse generator 211 and the signal F(n) of rolling force from the load cell 4, calculates a rolling force F(n−2) for the (n−2)th pass, and stores the calculated data of the rolling force. The calculator/memory 611 receives the signal S(PG) for transfer synchronization from the pulse generator 211 and the signal F(n) of rolling force from the load cell 4, calculates a rolling force F(n−1) for the (n−1)th pass, and stores the calculated data of the rolling force. The calculator 63 receives the signal S(PG) from the pulse generator 211, the signal S(PS) of the sensed roll gap length from the position sensor 34, the signal S(GC) of the command gap length from the gap length command element 64, and the signal F(n) of rolling force from the load cell 4, carries out a subtraction: $\Delta S = S(GC) - S(PS)$, carries out a calculation according to a plate thickness estimation equation to obtain the plate thickness H(n−2) for the (n−2)th pass, and subsequently carries out a calculation according to the above-mentioned equation to obtain the plate thickness H(n−1) for the (n−1)th pass.

The calculator/memories 622 and 621 store the data H(n−2) and H(n−1) from the calculator 63 and transmit the stored data H(n−1) to the calculator 65. The calculator 65 reads out the data H(n−2) and H(n−1) with respect to the corresponding position in the longitudinal direction of the plate, which is being rolled, from the calculator/memories 622 and 621, carries out calculations according to estimation equations, obtains a modification amount $\Delta S(n)'$ of the roll gap, and holds the thus obtained $\Delta S(n)'$. After that, the calcuator 65 receives the signal S(PG) from the pulse generator 211 during the nth pass and transmits the above held amount $\Delta S(n)'$ as the output signals to the operational amplifier 56 at each count of the pulse numbers for the above-mentioned corresponding position.

In the system of FIG. 1, a relay switch 55 is connected between the first operational amplifier 54 and the second operational amplifier 56, and the signal $\Delta S(n)$ from the superautomatic gauge control circuit 6A(SAG) is supplied to one (56C) of the input terminals of the second operational amplifier 56. Thus, superautomatic gauge control and feedback automatic gauge control can be carried out either independently or simultaneously in the system of FIG. 1.

When the relay switch 55 is in the ON state due to the potential of the signal S(661) from the switching device 66, and the second operational amplifier 56 is supplied with the signal S(662) of a predetermined potential from the switching device 66, only feedback automatic gauge control is carried out in the system of FIG. 1. When the relay switch 55 is in the OFF state due to the potential of the signal S(661) from the switching device 66, and the second operational amplifier 56 is not supplied with the signal S(662) from the switching device 66, only superautomatic gauge control is carried out in the system of FIG. 1. When the relay switch 55 is in the ON state due to the potential of the signal S(661) from the switching device 66, a weighting signal S(664) is supplied to the first operational amplifier 54, another weighting signal S(663) is supplied to the calculator 65, and the thus obtained signal $\Delta S'$ from the first operational amplifier and signal $\Delta S(n)$ from the calculator 65 are supplied to the second operational amplifier 56; both feedback automatic gauge control and superautomatic gauge control are carried out simultaneously. The switching device 66 is actuated by command signals from an operator panel or command signals from the master computer 7.

The fundamental structure of the feedback automatic gauge control circuit 5 is the same as that of the prior art feedback automatic gauge control circuit. The multiplier receives the signals of the rolling force F(n) and the mill constant 1/M and produces the signal representing the extension F(n)/M of stand. The lock-on memory 53 stores data $F_l/M$ obtained by the calculation according to a thickness estimation equation or data F(n)/M obtained immediately after the front edge of material 1 is gripped between the work rolls 21 and 22 which form a roll gap length S(o) according to the thickness estimation equation. The mill constant 1/M is supplied from the element 67. The $F_l/M$ is the extension of the roll stand supplied from the element 68, where $F_l$ is a preselected lock-on rolling force.

The first operational amplifier 54 receives the signal F(n)/M from the multiplier 51 and the signal from the lock-on memory 53 to carry out a comparison therebetween and produces the signal ΔS' indicating the difference therebetween as the signal for modifying the gap length. The second operational amplifier 56 receives the signal S(PS) from the position sensor 34, the signal ΔS' from the first operational amplifier 54, the signal ΔS(n) from the calculator 65, and the signal S(662) from the switching device 66 and produces a signal S(56) for controlling the control valve 32 to control the position of the lower backup roll 23 to control the gap length between the work rolls 21 and 22. The second operational amplifier 56 operates so as to realize the state in which the signal ΔS' is zero.

An example of the process of a calculation carried out in the direct digital controller 6 and the master computer 7 is illustrated in FIG. 2. The plate thickness estimation equations and the rolling force estimation equations will be explained below.

The estimations of plate thickness are expressed as follows:

$$H(n-2)=S(o)+\Delta S(n-2)+F(n-2)/M \quad (1)$$

$$H(n-1)=S(o)+\Delta S(n-1)+F(n-1)/M \quad (2)$$

where H(n−2) is the plate thickness at the (n−2)th pass which is the second preceding pass of the nth pass in which the superautomatic gauge control in question is carried out, H(n−1) is the plate thickness at the (n−1)th pass, which immediately precedes the above-mentioned nth pass, F(n−2) is the rolling force at the above-mentioned (n−2)th pass, F(n−1) is the rolling force at the above-mentioned (n−1)th pass, S(o) is the initially selected gap length between work rolls, and M is the mill constant.

The estimations of deformation resistance are expressed as follows:

$$K(n-1)=\frac{F(n-1)}{Q(n-1)\cdot b\cdot\sqrt{R_a(H(n-2)-H(n-1))}} \quad (3)$$

$$K(n)=\frac{K_a(n)}{K_a(n-1)}\cdot K(n-1) \quad (4)$$

$$K(n+1)=\frac{K_a(n+1)}{K_a(n-1)}\cdot K(n-1) \quad (5)$$

where K(n−1), K(n), and K(n+1) are deformation resistances in the (n−1)th, the nth, and the (n+1)th passes, respectively, Q(n−1) is the function of the screwdown force at the (n−1)th pass, b is the width of the plate which is being rolled $R_a$ is the radius of the roll taking the roll flattening into considerations, and $K_a(n-1)$, $K_a(n)$, and $K_a(n+1)$ are average estimated amounts of deformation resistance at the (n−1)th, the nth, and the (N+1)th passes, respectively.

The estimation of rolling force is expressed as follows:

$$F(n)=b\cdot\sqrt{R_a(H(n-1)-H(n))}\cdot d(n)\cdot Q(n) \quad (6)$$

where F(n) is the rolling force at the nth pass, d(n) is the deformation resistance at the nth pass, which is given as a function of contents of constituents such as carbon and manganese, rolling temperature, rate of screwdown, and rolling speed, and Q(n) is a function of the screwdown force at the nth pass.

The modification amount ΔS(n)' of the roll gap length is expressed as follows:

$$\Delta S(n)'=H(n)-S(o)-F(n)/M \quad (7)$$

The calculation flow of FIG. 2 comprises memorizing steps m1, m2, m3, m4, m5, m6, m7, m8, m9 m10, m11, and m12 and calculating steps C1, C2, C3, C4, C5, C6, C7, C8, and C9. The memorizing steps m1, m2, and m3 are provided for memorizing the measured amounts or the measured and calculated amounts. The memorizing steps m4, m5, m6, m7, m8, m9, and m10 are provided for memorizing the results of estimation calculations. The memorizing steps m11 and m12 are provided for memorizing the command amounts.

At the calculating steps C1 and C2, H(n−1) and H(n−1) are calculated by the estimation equations (1) and (2) from F(n−2), ΔS(n−2). The obtained H(n−2) and H(n−1) are stored at the memorizing steps m1 and m3. The rolling force F(n−1) is obtained from the load cell 4 and is memorized at the memorizing step m2. At the calculating step C3, K(n−1) is calculated by the estimation equation (3) from H(n−2), F(n−1), and H(n−1). The obtained K(n−1) is memorized at the memorizing step m4. At the calculating step C4, K(n) is calculated by the estimation equation (4) from the K(n−1) and is memorized at the memorizing step m5. At the calculating step C5, K(n+1) which is the deformation resistance in any one of the passes subsequent to the nth pass, for example, the (n+1)th pass, is calculated by the estimation equation (5) from K(n). The above-mentioned subsequent passes may include the finishing pass and are memorized at the memorizing step m6.

At the calculating step C6, H(n) is obtained by solving the estimation equation (6) from H(n+1), F(n+1), and K(n+1) with an assumption that H(n+1) and F(n+1) are constant during the (n+1)th pass and is memorized at the memorizing step m10. At the calculating step C7, F(n) is calculated by the estimation equation (6) from H(n−1), K(n), and H(n) and is memorized at the memorizing step m7.

At the calculating step C8, ΔSn' is calculated by the estimation equation (7) from F(n) and H(n) and is memorized at the memorizing step m8. At the calculating step C9, ΔS(n) is calculated by multiplying ΔS(n)' by the constant gain G and is memorized in the memorizing step m9.

In the operation of the system of FIG. 1, it is possible up to the (n−1)th pass to use the conventional method of feedback automatic gauge control of the plate thickness, the conventional method of feed-forward automatic gauge control of the plate thickness, or the conventional method of combined feedback and feed-forward automatic gauge control of the plate thickness.

In the case where the (n+1)th pass is the finishing pass, the constant gain G is selected to be equal to unity (G=1). There is no change in the roll gap and no change in the rolling force during this (n+1)th pass and hence the thickness H(n+1) becomes uniform.

In the case where the finishing pass occurs at the (n+2)th or later pass and a second superautomatic gauge control according to the present invention is carried out in any pass from the (n+1)th pass to the preceding pass of the finishing pass, the constant gain G is selected to be greater than unity (G>1). In this case, the thickness of the plate immediately before the above-mentioned second superautomatic gauge control pass is similar to the thickness H(n) of the plate at the nth pass, in which the thickness of the skid mark portion of the plate is made thin and the difference of the plate thickness between the skid mark portion and the other portion immediately before the above-mentioned second superautomatic gauge control pass is less than that at the nth pass, and hence the ΔS' at the above-mentioned second superautomatic gauge control pass can be made small. Thus, by carrying out a first superautomatic gauge control while the plate thickness is relatively large and the plate is holding a relatively stable shape and by selecting G with regard to ΔS' as "G>1", it is possible to make ΔS' small at the above-mentioned second superautomatic gauge control pass where the plate thickness is relatively thin and to make the shape of the plate stable after the above-mentioned second superautomatic gauge control pass.

Figures 3, 3A:
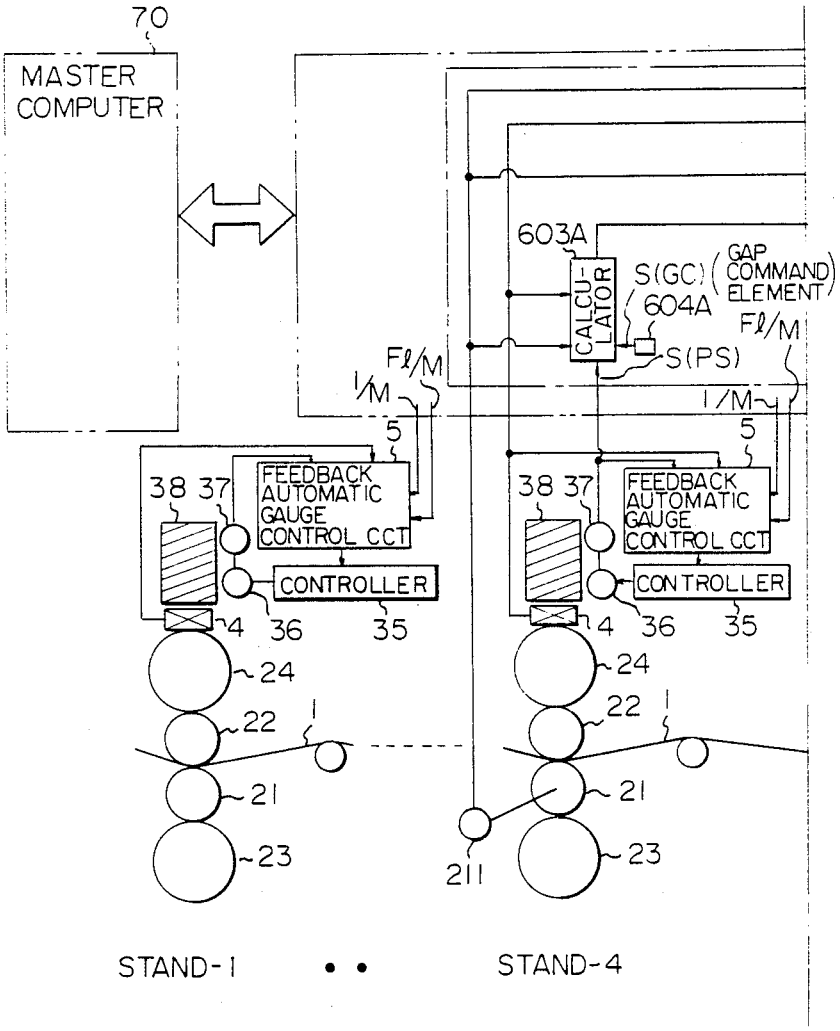
FIGS. 3A and 3B illustrate a system used for carrying out a method of rolling metal in accordance with another embodiment of the present invention.
Figure 3B:
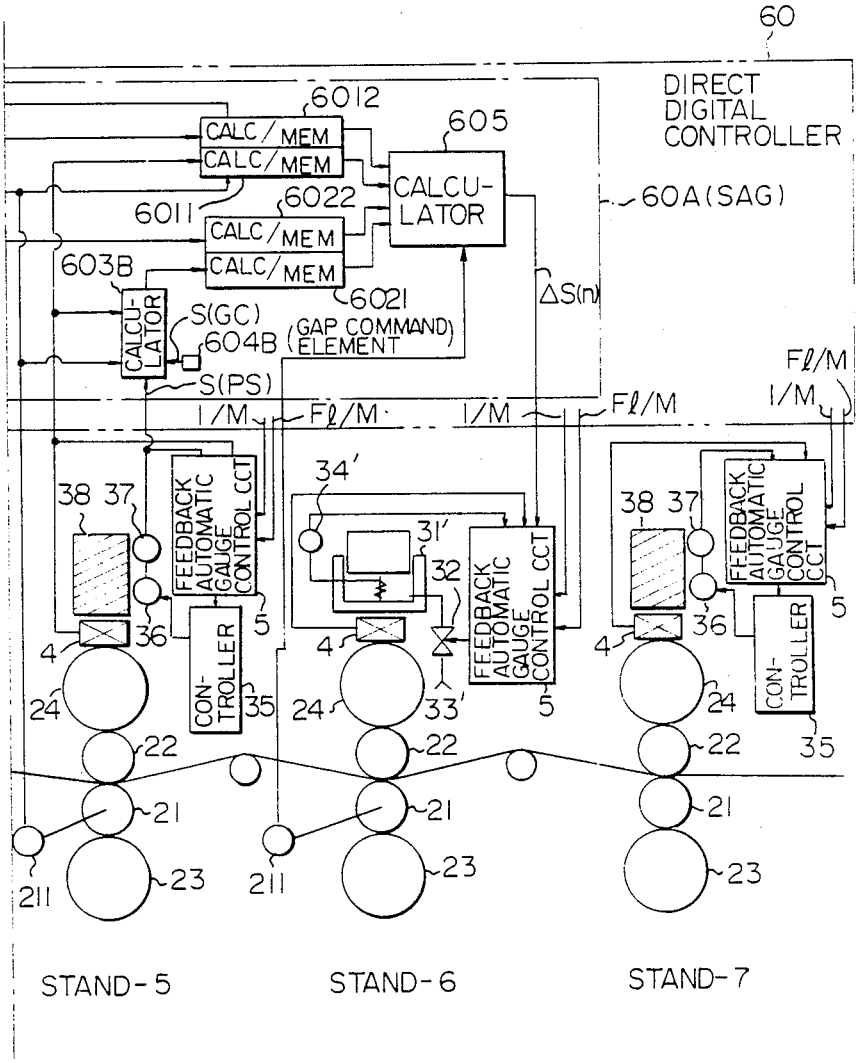

Another example of the system used for carrying out the method of rolling in a sequence of passes in accordance with the present invention is illustrated in FIG. 3. The system of FIG. 3 is applied to a tandem continuous hot strip mill with seven roll stands.

Steel strip 1 to be rolled passes successively through a sequence of roll stands STAND-1 through STAND-7. The STAND-1, 2, 3, 4, 5, 6, and 7 correspond to the (n−5)th, (n−4)th, (n−3)th, (n−2)th, (n−1)th, nth, and (n+1)th passes, respectively. The STAND-7 which corresponds to the (n+1)th pass is the finishing pass.

Illustrations of STAND-2 and STAND-3 are omitted in FIG. 3.

STAND-1 through STAND-7 each provides a feedback automatic gauge control circuit which is the same as the feedback automatic gauge control circuit 5 in FIG. 1. In STAND-1 through STAND-5 and STAND-7, variable roll gap driving mechanisms of the screw type are provided. Each of such variable roll gap driving mechanisms provides a screw 38, a driving motor 36, a controller 35 for the driving motor 36, and a position sensor 37 for sensing the roll gap length controlled by the operation of the screw 38 of the variable roll gap driving mechanism. The variable roll gap driving mechanism of STAND-6 is similar to the variable roll gap driving mechanism 31, 32, 33, and 34 of FIG. 1.

In the system of FIG. 3, the pass for which the superautomatic gauge control is applied is the pass carried out by STAND-6. The calculator/memories 6012, 6011, 6022, and 6021 of the superautomatic gauge control circuit 60A receive the signals from the pulse generators 211 of STAND-4 and STAND-5 and the signals from the load cells 4 of STAND-4 and STAND-5. The calculator 603A receives the signal from the pulse generator 211, the signal from the load cell 4, the signal from the position sensor 34' of STAND-4, and the signal from the gap command element 604A. The calculator 603B receives the signal from the pulse generator 211, the signal from the load cell 4, the signal from the position sensor 34' of STAND-5, and the signal from the gap command element 604B.

The output signal of the calculator 603A is supplied to the calculator/memory 6022, while the output signal of the calculator 603B is supplied to the calculator/memory 6021. The calculator 605 receives the output signals of the calculator/memories 6012, 6011, 6022, and 6021 and the signal of the pulse generator 211 of STAND-6 and produces the signal ΔS(n) which is supplied to the feedback automatic gauge control circuit 5 of STAND-6.

Figures 4A, 4B, 4C:
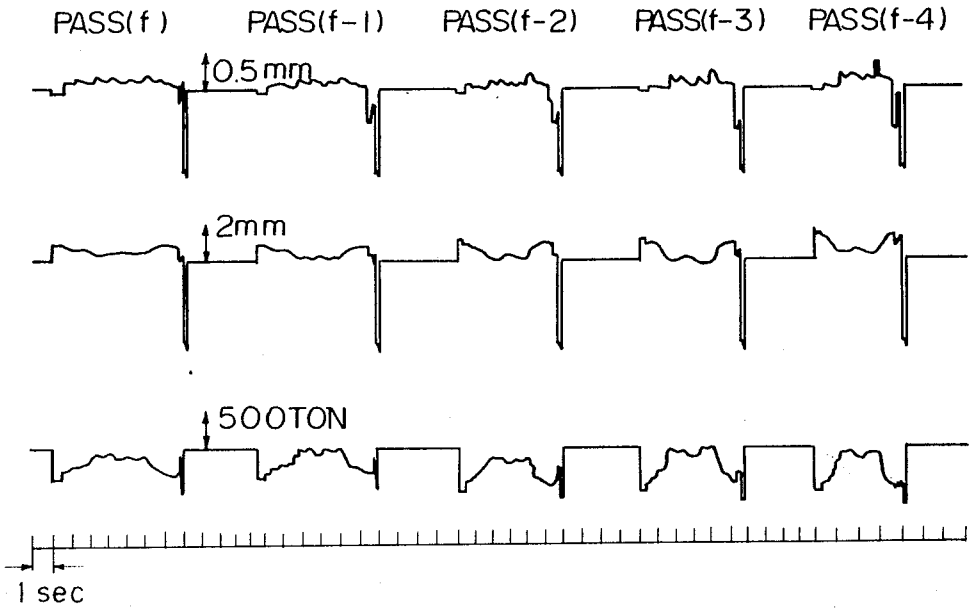
Figures 5A, 5B, 5C:
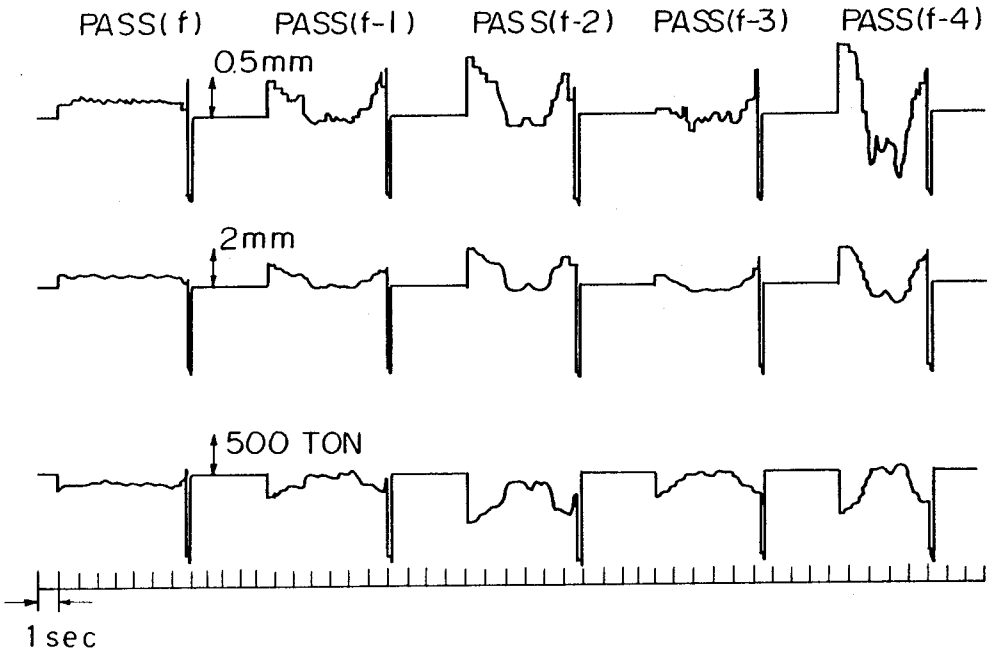

FIGS. 4, 5, 6, and 7 illustrate the changes with time of (a) the calculated plate thickness, (b) the roll gap length, and (c) the rolling force. FIG. 4 illustrates the changes with time in accordance with a prior art feedback automatic gauge control system for a reversing mill with a single roll stand. FIG. 5 illustrates the changes with time in accordance with an embodiment of the present invention for a reversing mill with a single roll stand. FIG. 6 illustrates the changes with time in accordance with a prior art feedback automatic gauge control system for a tandem continuous hot strip mill with seven roll stands. FIG. 7 illustrates the changes with time in accordance with an embodiment of the present invention for a tandem continuous hot strip mill with seven roll stands.

In FIGS. 4 and 5, PASS(f), PASS(f−1), PASS(f−2), PASS(f−3), and PASS(f−4) represent the finishing pass, the immediately preceding pass, the second preceding pass, the third preceding pass, and the fourth preceding pass, respectively. In FIG. 5, the superautomatic gauge controls are carried out at PASS(f−2) and PASS(f−4). In the cases of FIGS. 4 and 5, steel SS41 for rolled steel plate produced for general structural use is used, which has a slab size of 252×1898×5060 mm and has rolled size of 26×3140×29665 mm. In FIGS. 6 and 7, PASS(f), PASS(f−1), PASS(f−2), and PASS(f−3) represent the finishing pass, the immediately preceding pass, the second preceding pass, and the third preceding pass, respectively. In FIG. 7, the superautomatic gauge control is carried out at PASS(f−1). In the cases of FIGS. 6 and 7, steel SS41 is used, which has a slab size of 253×1259×5050 mm and has rolled size of 8.9×1250×142000 mm. From comparisons between FIG. 4 and FIG. 5, and between FIG. 6 and FIG. 7, it will be understood that the rolling force is more uniform and hence the variation of the roll gap length is less in the system of the present invention than those in prior art systems.

Comparisons of data obtained from actual operations of a prior art system and a system according to the present invention are illustrated in FIGS. 8 and 9. FIG. 8 is for the case of a reversing mill with a single roll stand, while FIG. 9 is for the case of a tandem continuous hot strip mill. In each width column of FIGS. 8 and 9, data obtained by the prior art system are indicated to the left, while data obtained by the present invention system are indicated to the right. In each half of the width column, the figure in the first row indicates the number of the rolled steel plates in pieces, the figure in the second row indicates the average ($\overline{X}$) of deviation of plate thickness along the longitudinal direction of the rolled steel plate in millimeters, and the figure in the third row indicates the standard deviation ($\sigma$) of the deviation of plate thickness along the longitudinal direction of the rolled steel plate in millimeters. In FIG. 8, plate thicknesses such as <10.0 mm, <15.0 mm, <20.0 mm, <30.0 mm, and ≧30.0 mm are given vertically, while plate widths such as <2000 mm, <2500 mm, <3000 mm, <4000 mm, and ≧4000 mm are given horizontally. In FIG. 9, plate thicknesses such as <1.8 mm, <2.0 mm, <2.3 mm, <3.0 mm, <4.0 mm, <5.0 mm, <6.0 mm, <8.0 mm, <10.0 mm, and ≧10.0 mm are given vertically, while plate widths such as <700 mm, <900 mm, <1100 mm, <1300 mm, <1600 mm, <2000 mm, and ≧2000 mm are given horizontally.

In FIGS. 8 and 9, it can be seen that both the average (E,ovs/X/ ) of deviation of plate thickness along the longitudinal direction of the rolled steel plate and the standard deviation ($\sigma$) of the deviation of plate thickness along the longitudinal direction of the rolled steel plate are considerably reduced in the present invention from the prior art. From data indicated in FIGS. 8 and 9, it will be understood that, in accordance with the present invention, rolled steel plate having uniform plate thickness can be obtained regardless of the considerably large variation in deformation resistance due to skid marks or the like.

Although the preferred embodiments of the present invention have been described hereinbefore, various modifications are possible in embodying the present invention. For example, although the rolling of steel into a plate or a sheet is carried out, in the above-described embodiment, it is also possible to apply the method of rolling according to the present invention to the rolling of steel into shapes and the like where the variation in deformation resistance along the longitudinal direction of metal becomes an important problem.

We claim:

1. A method of rolling metal for producing a metal plate or a metal sheet having a desired range of thickness through a sequence of rolling passes, said method comprising the steps of:

detecting variations in deformation resistance of the metal which is being rolled along a longitudinal direction of the metal;

estimating, on the basis of the detected variations in the deformation resistance of the metal of at least one preceding pass, the variations in deformation resistance and a resulting variations in rolling force in the finishing pass along the longitudinal direction of the metal using a rolling force estimation equation and a deformation resistance estimation equation;

calculating and physically forming a distribution of thickness of the metal before the entrance of the finishing pass along the longitudinal direction of the metal, using said estimated variations in deformation resistance and in rolling force; and rolling the metal so as to obtain the distribution of the thickness of the metal necessary to cancel the variation in the rolling force at the entrance of the finishing pass.

2. A method of rolling metal for producing a metal plate or a metal sheet having a desired range of thickness through a sequence of rolling passes, said method comprising the steps of: calculating from a rolling force and the roll gap length metal thicknesses H(n−2) and H(n−1) along a longitudinal direction of the metal, that is, the metal thicknesses at an (n−2)th pass and an (n−1)th pass, respectively, where an nth pass is a pass preceding a finishing pass; calculating, in accordance with a rolling force estimation equation, a deformation resistance K(n−1) along the longitudinal direction of the metal at the (n−1)th pass from the H(n−2) and, the H(n−1) thicknesses as well as a rolling force F(n−1) along the longitudinal direction of the metal at the (n−1)th pass; calculating, in accordance with a deformation resistance estimation equation, a deformation resistance K(n) along the longitudinal direction of the metal at the nth pass; calculating, in accordance with a deformation resistance estimation equation, a deformation resistance K(n+1) along the longitudinal direction of the metal at an (n+1)th pass; calculating a metal thickness H(n) which should be attained at the nth pass, using a rolling force estimation equation, from a command rolling force F(n+1) at the (n+1)th pass, a command metal thickness H(n+1) at the (N+1)th pass, and K(n+1), said command rolling force F(n+1) and command metal thickness H(n+1) being assumed constant during the (n+1)th pass; calculating, in accordance with the rolling force estimation equation, a rolling force F(n) along the longitudinal direction of the metal at the nth pass from the H(n), the H(n−1), and the K(n); calculating the roll gap length or a variation ΔS(n)′ of the roll gap length corresponding to each of a plurality of points along the longitudinal direction of the metal; and rolling the metal at the nth pass, using a command roll gap length or a variation ΔS(n) of the roll gap length obtained by multiplying ΔS(n)′ by a constant G, in synchronization with displacement of the metal.

3. A method as defined in claim 2, wherein the rolling of the metal is carried out in a reversing mill with a single roll stand, employing a combination of feedback automatic gauge control processes and feed-forward automatic gauge control processes.

4. A method as defined in claim 2, wherein the rolling of metal is carried out in a tandem continuous hot strip mill with a plurality of roll stands, employing a combination of feedback automatic gauge control processes and feed-forward automatic gauge control processes.

* * * * *